US005217356A

United States Patent [19]

Ryuhzaki

[11] Patent Number: 5,217,356

[45] Date of Patent: Jun. 8, 1993

[54] FUEL INJECTION PUMP

[75] Inventor: Kohtaroh Ryuhzaki, Higashi-Matsuyama, Japan

[73] Assignee: Zexel Corporation, Japan

[21] Appl. No.: 895,772

[22] Filed: Jun. 9, 1992

[30] Foreign Application Priority Data

Jun. 19, 1991 [JP] Japan ..... 3-54497[U]

[51] Int. Cl.[5] ..... F04B 7/04

[52] U.S. Cl. ..... 417/499; 417/500; 123/500

[58] Field of Search ..... 417/490, 499, 500; 123/500, 503, 506

[56] References Cited

U.S. PATENT DOCUMENTS 4,448,167 5/1984 Schmid et al. ..... 123/503

4,836,170 6/1989 Hafele ..... 417/499

FOREIGN PATENT DOCUMENTS 63-503076 3/1987 Japan .

*Primary Examiner*—Richard A. Bertsch

*Assistant Examiner*—Charles G. Freay

*Attorney, Agent, or Firm*—Ostrolenk, Faber, Gerb & Soffen

[57] ABSTRACT

A fuel injection pump that provides an improved fuel injection cutoff spill rate at high fuel pressures without degrading the mechanical strength or durability of a control sleeve that is provided with a spill port and fits over the plunger of the pump, and also does not affect fuel injection timing. In the fuel injection pump the length of an inclined lead is extended in the high rack direction, the effective fuel injection stroke is adjusted by controlling the relative positions of the inclined lead and the spill port, and an auxiliary inclined lead is formed on the end portion of the inclined lead in communication therewith, with this auxiliary inclined lead arranged so that it does not extend below the fuel suction and discharge port in the longitudinal direction of the plunger.

13 Claims, 5 Drawing Sheets

FUEL INJECTION PUMP

BACKGROUND OF THE INVENTION

1. Field of the Invention

This invention relates to a fuel injection pump, and particularly to a fuel injection pump that has an improved fuel cutoff (spill rate) at the completion of the fuel injection.

2. Description of the Prior Art

In conventional fuel injection pumps provided on diesel engines, especially in-line type fuel injection pumps such as for example that of Japanese Patent Publication No. Sho 63-183264, the usual arrangement used to control the fuel injection amount and effective stroke consists of an inclined lead in the form of a spiral groove provided on the plunger, and a spill port formed in the control sleeve at a position corresponding to the position of the inclined lead.

This will now be explained with reference to FIGS. 3, 4 and 5. FIG. 3 is a cross-sectional side view of part of a conventional fuel injection pump 1 during the start of the fuel injection, and FIG. 4 is a cross-sectional side view of the pump at the completion of the fuel injection operation. The fuel injection pump 1 has a delivery valve/pump housing 2 and a plunger barrel 3 provided inside the pump housing 2, and has a fuel reservoir chamber 4 inside.

Extending from the pump housing 2 to the plunger barrel 3 is a plunger 5 that can rotate and reciprocate therein. Above the plunger 5 is a high-pressure fuel compression chamber and plunger chamber 6 that communicates with a delivery valve (not shown). The plunger 5 has a fuel suction and discharge port 7, a central fuel passage 8 that communicates the fuel suction and discharge port 7 with the plunger chamber 6, a vertical groove 9 that communicates with the fuel suction and discharge port 7, formed on the surface of the plunger, and an inclined control lead 10 that is also formed on the plunger surface, in communication with the vertical groove 9.

A control sleeve 11 is fitted over the plunger 5. A control rod (not shown) is used to move the control sleeve 11 vertically to change the relative positions of the control sleeve 11 and plunger 5 and thereby enable the prestroke to be adjusted. The control sleeve 11 is provided with a spill port 12 that passes radially therethrough. In addition, in the axial direction the location of the spill port 12 coincides with that of the inclined lead 10.

With the fuel injection pump 1 thus constituted, the descent of the plunger 5 causes fuel in the fuel reservoir chamber 4 to be drawn in via the fuel suction and discharge port 7, and the ascent of the plunger 5 causes the fuel suction and discharge port 7 to be closed by the lower end 11A of the control sleeve 11, starting pressurization of the fuel (FIG. 3). As shown by FIG. 5, which is an enlarged view of the fuel suction and discharge port 7, inclined lead 10 and spill port 12, as the fuel compression and injection timing are set by the lowermost point 7A of the fuel suction and discharge port 7, the lowermost point 10A of the inclined lead 10 must not be lower than the lowermost point 7A.

Again with reference to FIGS. 4 and 5, as the plunger 5 rises further, the upper edge 10B of the inclined lead 10 comes into alignment with the spill port 12 and the plunger chamber 6 and fuel reservoir chamber 4 are brought into communication via the central fuel passage 8, fuel suction and discharge port 7, vertical groove 9 and inclined lead 10, whereby fuel injection is terminated by a prescribed amount of fuel being spilled from the spill port 12 into the fuel reservoir chamber 4 (fuel spill timing). The fuel injection amount is controlled by a control rack (not shown) that rotates the plunger 5 about its axis to change the relative positional relationship between the inclined lead 10 and the spill port 12, thereby adjusting the effective fuel delivery stroke (FIG. 3). Also, the timing of the fuel injection can be advanced or retarded by using the vertical operation of the control sleeve 11 to adjust the prestroke.

With respect to a conventional fuel injection pump 1 employing these processes of fuel intake, compression, delivery and spill, it has been known that emission performance can be improved by improving the cutoff at the fuel injection termination by increasing the fuel spill amount per prescribed unit angle of pump rotation, that is, by increasing the spill rate.

In the case of Japanese Patent Publication No. Sho 63-183264, for example, the spill rate is increased by increasing the diameter of the spill port 12 formed in the control sleeve 11. However, increasing the diameter of the spill port 12 gives rise to various problems such as that it reduces the strength of the control sleeve 11 and thereby increases deformation, and, in addition, this arrangement limits the rate at which the area of the spill port 12 is opened by the lift of the plunger 5.

Moreover, using a higher pressure for the fuel injection tends to increase the effective stroke S, and with the shape of the inclined lead 10 used in the conventional arrangement, as shown particularly by FIG. 5, spill performance is degraded by the fact that the area of the port that is open at the termination of fuel injection at the high rack position (solid line) used to increase the effective stroke S is very small compared to the area at the low rack position (broken line).

That is, when the spill port 12 is near the end of the inclined lead 10, i.e. in the high rack position, the area of the spill port 12 that is open is limited to the portion (shown by cross-hatching) that is on the vertical groove 9 side (to the left, in the drawing) of the end point 10C on the long side of the inclined lead 10. While the inclined lead 10 can be further extended to ensure a sufficient port area in the high rack position, the start of the fuel injection operation to be mistimed if the lowermost point 10A is lower than the lowermost point 7A of the fuel suction and discharge port 7.

SUMMARY OF THE INVENTION

It is therefore an object of this invention to provide a fuel injection pump in which it is possible to improve the fuel injection cutoff at higher fuel injection pressures without reducing the mechanical strength or durability of the control sleeve and without affecting the fuel injection timing.

In accordance with the present invention, this object is achieved by a fuel injection pump in which the length of the inclined lead can be extended in the high rack direction, comprising a plunger that reciprocates within a high pressure plunger chamber to suck in and deliver fuel, a control sleeve that fits over the plunger and has a spill port formed therein, a fuel suction and discharge port and an inclined lead in communication with this fuel suction and discharge port formed on the plunger, in which the effective fuel injection stroke is adjusted by controlling the relative positions of the inclined lead and spill port, wherein an auxiliary inclined lead is formed on the end portion of the inclined lead in communication therewith that does not extend below the fuel suction and discharge port in the longitudinal direction of the plunger. In shape, the auxiliary inclined lead may be narrower than the conventional inclined lead or tapered.

With the fuel injection pump according to this invention, as the end portion of the inclined lead is provided with an auxiliary inclined lead that does not extend below the fuel suction and discharge port in the longitudinal direction of the plunger, even in the high rack position, the area of communication between the control sleeve spill port is greater than in the conventional arrangement, increasing the spill opening area, whereby the spill rate is improved by the communication of this enlarged spill port area with the inclined lead.

Further features of the invention, its nature and various advantages will become more apparent from the accompanying drawings and following detailed description of the invention.

DESCRIPTION OF THE PREFERRED EMBODIMENT

Figure 3:
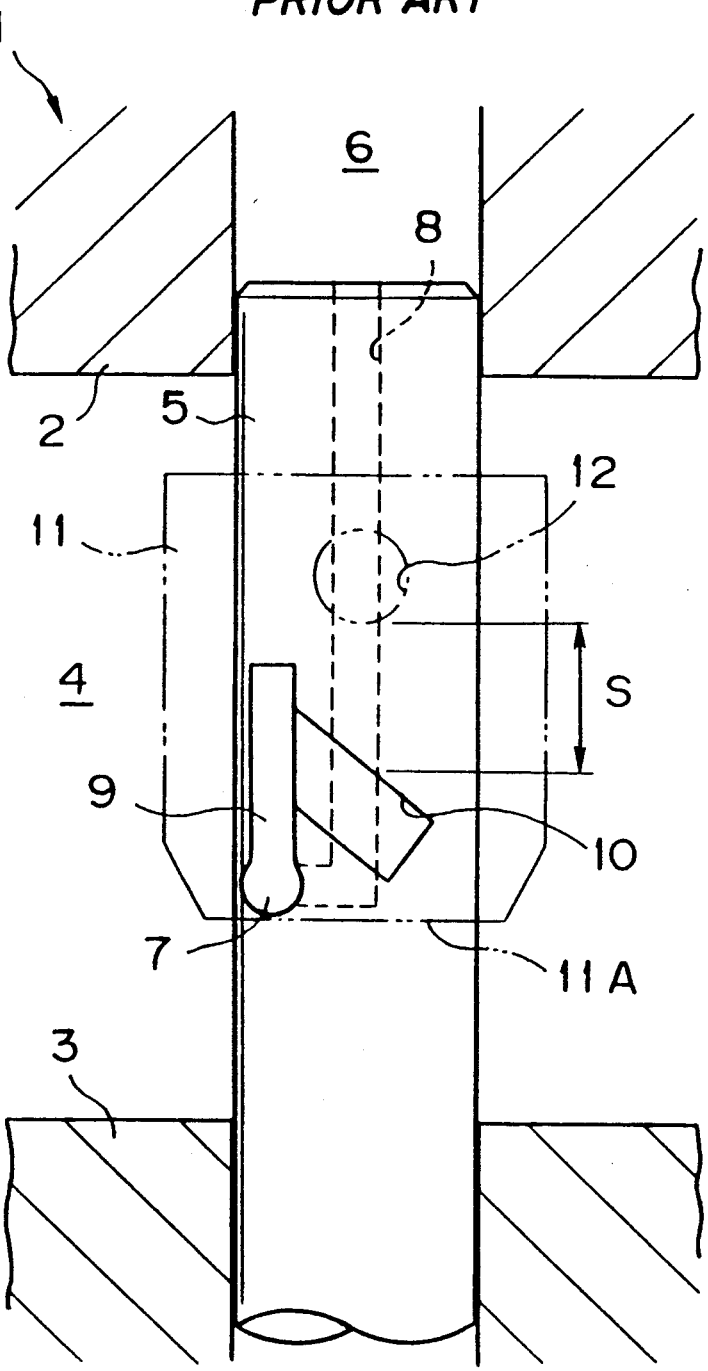
FIG. 3 PRIOR ART
FIG. 3 is a cross-sectional side view of part of a conventional fuel injection pump at the start of the fuel injection operation.
Figure 4:
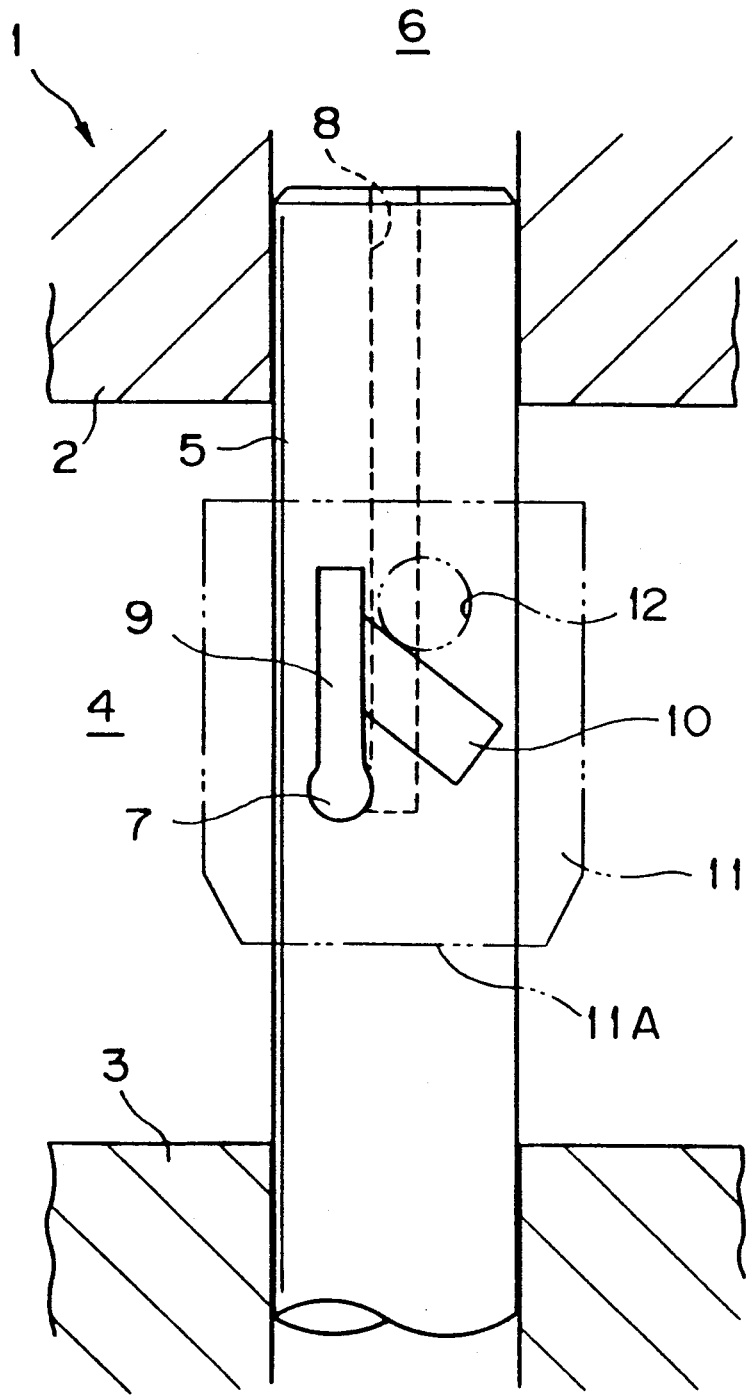
FIG. 4 PRIOR ART
FIG. 4 is a cross-sectional side view of the pump of FIG. 3 at the completion of the fuel injection operation.

An embodiment of the present invention will now be described with reference to FIGS. 1 and 2. Parts which are the same as those described with reference to FIGS. 3 to 5 have been given the same reference numerals, and the description thereof is omitted.

Figure 1:
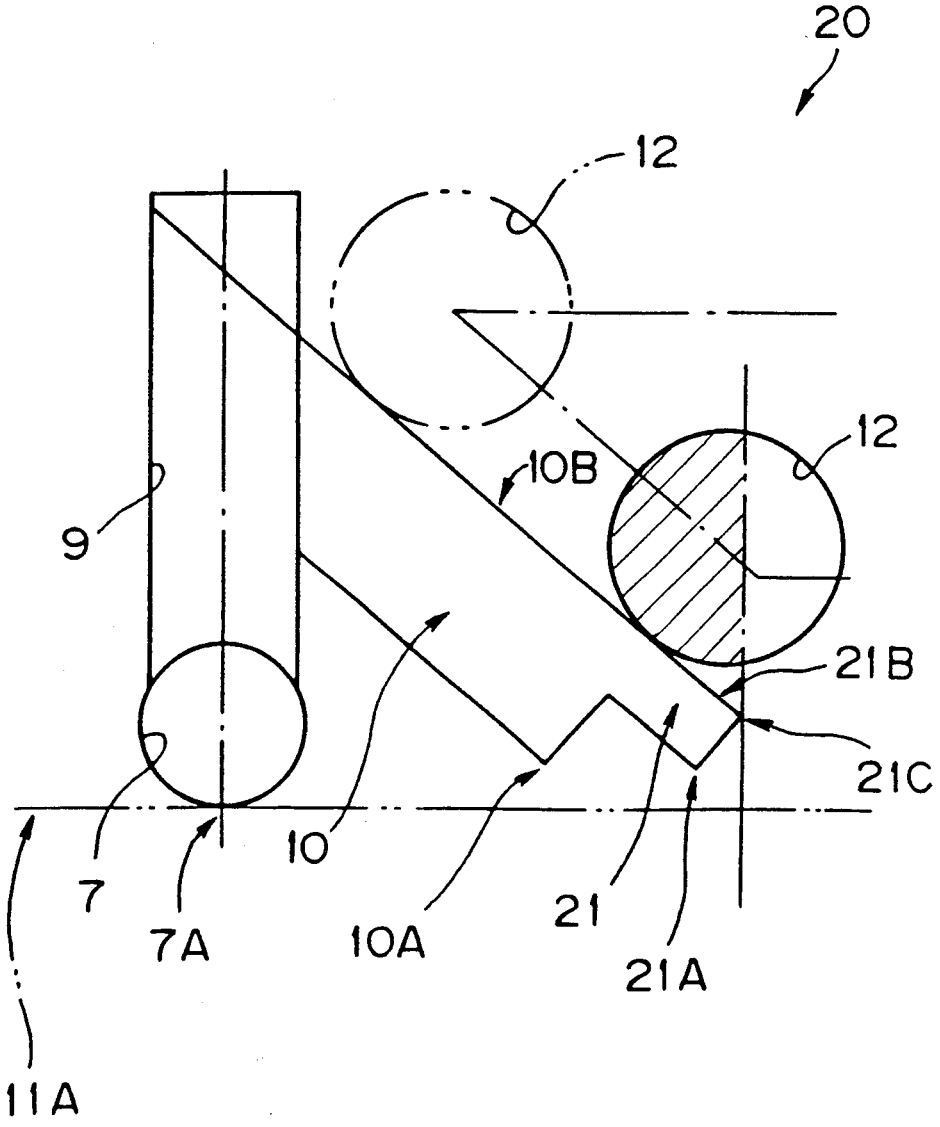
FIG. 1 is an enlarged view of the principal parts of a fuel injection pump according to an embodiment of this invention.
Figure 5:
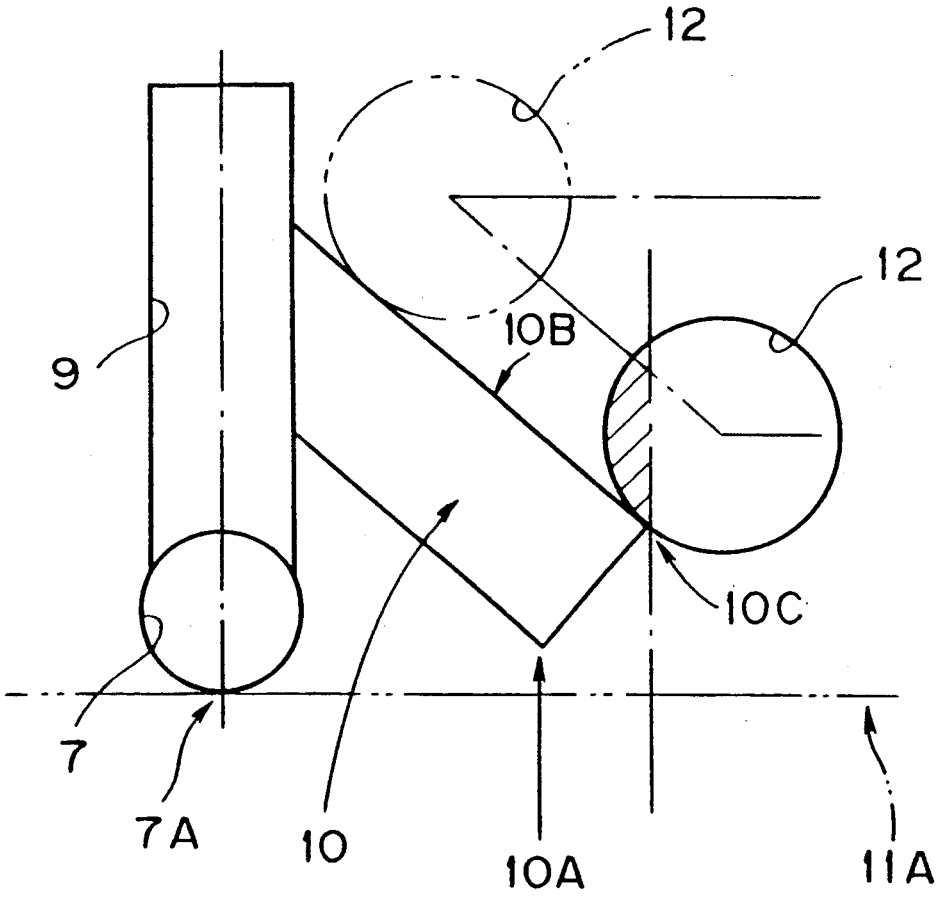
FIG. 5 PRIOR ART
FIG. 5 is an enlarged view of the principal parts of the same fuel injection pump.

FIG. 1 is an enlarged view of the principal parts of a fuel injection pump 20, corresponding to the view of FIG. 5. With reference to FIG. 1, formed on the end of the inclined lead 10 is an auxiliary inclined lead 21 that communicates with the inclined lead 10, thus forming a stepped inclined lead portion.

The lowermost point 21A of the auxiliary inclined lead 21 is arranged so that it is substantially level with the lowermost point 10A of the inclined lead 10 and is not lower than the lowermost point 7A of the fuel suction and discharge port 7. The upper edge 21B of the auxiliary inclined lead 21 is an extension of the inclined lead 10 upper edge 10B with which it forms a straight line. Therefore, the long-side end point 21C of the auxiliary inclined lead 21 has a higher rack position (towards the right, in the drawing) than the long-side end point 10C of the inclined lead 10.

The fuel injection pump 20 thus configured uses the same fuel intake, compression and delivery operations as the conventional arrangement. Even in the high rack position when the plunger 5 is rotated to the left, with reference to the drawing, to increase the effective stroke by shifting the relative position of the spill port 12 to the end point of the inclined lead 10, during fuel spill the spill port 12 is able to maintain communication up to the long-side end point 21C of the auxiliary inclined lead 21, producing a larger spill port opening area (the cross-hatched portion) than that of the conventional arrangement.

Figure 2:
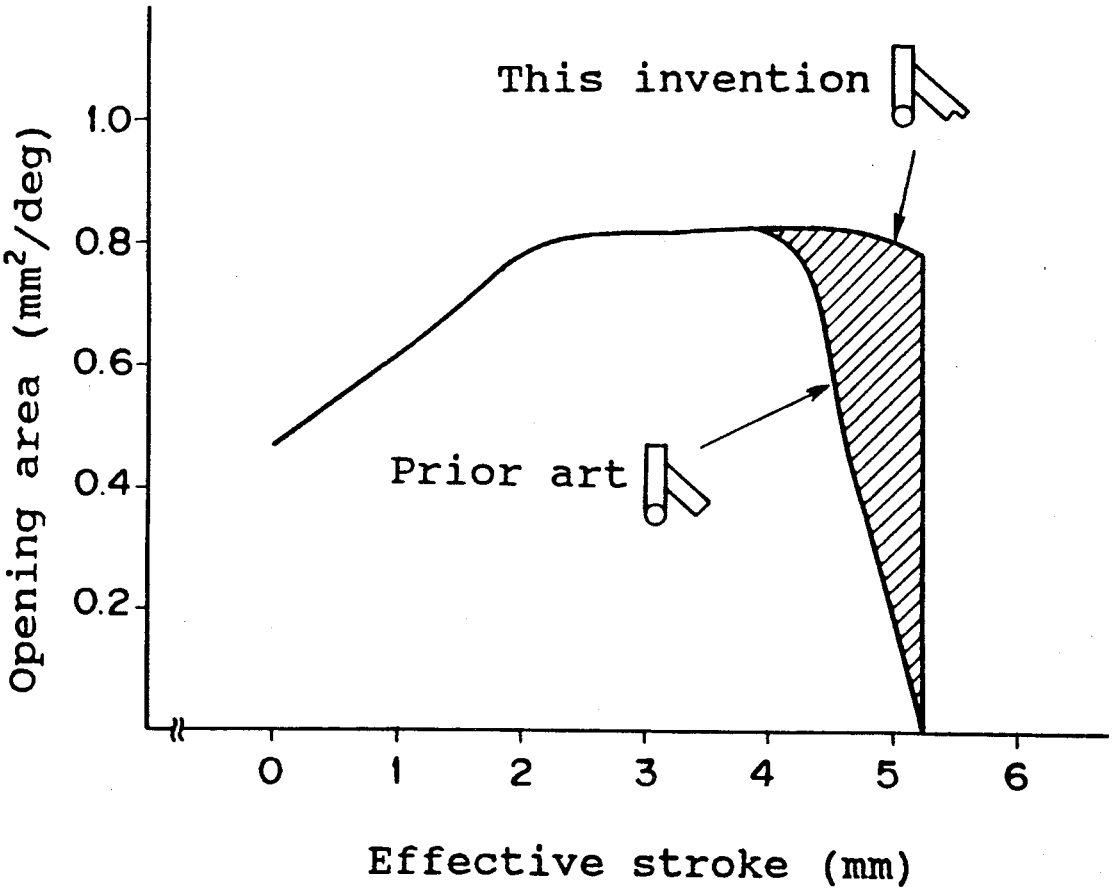
FIG. 2 is a graph depicting the relationship between effective stroke and spill port area.

FIG. 2 shows the relationship between effective stroke and the area of the port opening. Compared to the conventional arrangement in which there is no auxiliary inclined lead 21, with the arrangement of this invention that includes the auxiliary inclined lead 21, even if the effective stroke is increased it is possible to improve spill performance at the high rack position, without much change to the port opening area.

Moreover, as the lowermost point 21A of the auxiliary inclined lead 21 is arranged so that it is not lower than the lowermost point 7A of the fuel suction and discharge port 7, it does not affect the timing of the start of the fuel injection by the lower end 11A of the control sleeve 11 cutting off the fuel suction and discharge port 7.

The auxiliary inclined lead may be narrower than the conventional inclined lead, or tapered, or of any other desired shape.

What is claimed is:

1. A fuel injection pump comprising:

a plunger that reciprocates within a high pressure plunger chamber to suck in and deliver fuel;

a control sleeve that fits over the plunger and has a spill port formed therein;

a fuel suction and discharge port formed on the plunger together with an inclined lead in communication with this fuel suction and discharge port, with the effective fuel injection stroke being adjusted by controlling the relative positions of the inclined lead and spill port;

wherein an auxiliary inclined lead is formed on the end portion of the inclined lead in communication therewith that does not extend below the fuel suction and discharge port in the longitudinal direction of the plunger; and the upper edge of the auxiliary inclined lead is formed as an extension of the upper edge of the inclined lead.

2. A fuel injection pump according to claim 1 wherein with the ascent of the plunger the fuel suction and discharge port is closed by the lower end of the control sleeve and fuel injection is started, and fuel injection is terminated by the inclined lead coming into engagement and communication with the spill port.

3. A fuel injection pump according to claim 1 wherein the auxiliary inclined lead is formed on the end of the inclined lead in the direction in which the effective stroke of the plunger is increased.

4. A fuel injection pump according to claim 1 wherein the lowermost the auxiliary inclined lead is higher than the lowermost point of the fuel suction and discharge port.

5. A fuel injection pump according to claim 1 wherein the width of the auxiliary inclined lead is less than the width of the inclined lead.

6. A fuel injection pump according to claim 1 wherein the auxiliary inclined lead is tapered towards the end thereof.

7. A fuel injection pump according to claim 1 wherein the auxiliary inclined lead is formed in a direction in which the effective stroke of the plunger is increased.

8. A fuel injection pump comprising:

a plunger that reciprocates within a high pressure plunger chamber to suck in and deliver fuel;

a control sleeve that fits over the plunger and has a spill port formed therein;

a fuel suction and discharge port formed on the plunger together with an inclined lead in communication with this fuel suction and discharge port, with the effective fuel injection stroke being adjusted by controlling the relative positions of the inclined lead and spill port;

wherein an auxiliary inclined lead is formed on the end portion of the inclined lead in communication therewith that does not extend below the fuel suction and discharge port in the longitudinal direction of the plunger; and the auxiliary inclined lead is tapered towards the end thereof.

9. A fuel injection pump according to claim 8, wherein with the ascent of the plunger the fuel suction and discharge port is closed by the lower end of the control sleeve and fuel injection is started, and fuel injection is terminated by the inclined lead coming into engagement and communication with the spill port.

10. A fuel injection pump according to claim 8, wherein the auxiliary inclined lead is formed on the end of the inclined lead in the direction in which the effective stroke of the plunger is increased.

11. A fuel injection pump according to claim 8, wherein the lowermost point of the auxiliary inclined lead is higher than the lowermost point of the fuel suction and discharge port.

12. A fuel injection pump according to claim 8, wherein the width of the auxiliary inclined lead is less than the width of the inclined lead.

13. A fuel injection pump according to claim 8, wherein the auxiliary inclined lead is formed in a direction in which the effective stroke of the plunger is increased.

* * * * *